US012781646B2

(12) United States Patent
Císar et al.

(10) Patent No.: US 12,781,646 B2
(45) Date of Patent: Nov. 3, 2026

(54) VALVE BRIDGE

(71) Applicant: Eaton Intelligent Power Limited, Dublin (IE)

(72) Inventors: Ondrej Císar, Dvur Kralove nad Labem (CZ); Ondrej Bolehovský, Prague (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 19/179,924

(22) Filed: Apr. 15, 2025

(65) Prior Publication Data

US 2026/0160189 A1 Jun. 11, 2026

Related U.S. Application Data

(63) Continuation of application No. PCT/EP2023/025460, filed on Nov. 3, 2023.

(60) Provisional application No. 63/382,470, filed on Nov. 4, 2022.

(51) Int. Cl.
*F01L 1/18* (2006.01)
*F01L 13/06* (2006.01)

(52) U.S. Cl.
CPC ..... *F01L 1/18* (2013.01); *F01L 13/06* (2013.01)

(58) Field of Classification Search
CPC ..... F01L 1/18; F01L 13/06; F01L 1/46; F01L 1/267; F01L 1/181; F01L 2309/00; F01L 2303/00
See application file for complete search history.

(56) References Cited

U.S. PATENT DOCUMENTS 6,273,042 B1 * 8/2001 Perez ..... F01L 1/46 123/90.47
2009/0266317 A1 * 10/2009 Meacock ..... F01L 1/26 123/90.4
2014/0326212 A1 * 11/2014 Baltrucki ..... F01L 13/06 123/321
2015/0354418 A1 * 12/2015 Jo ..... F01L 1/267 123/90.43
2023/0007897 A1 * 1/2023 Hodgkinson ..... F01L 1/462

FOREIGN PATENT DOCUMENTS

BR PI0610172 A2 6/2010
WO WO 2015191663 A1 12/2015
WO WO 2017157413 A1 9/2017
WO WO-2017177102 A1 * 10/2017 ..... F01L 1/24

OTHER PUBLICATIONS

International search report and Written Opinion received for PCT Application No. PCT/EP2023/025460, 10 pages, Feb. 21, 2024.

* cited by examiner

*Primary Examiner* — Shafiq Mian
(74) *Attorney, Agent, or Firm* — Meunier Carlin & Curfman LLC

(57) ABSTRACT

A valve bridge for a rocker arm assembly is provided, which comprises a first end, a second end, and a top surface of a bridge body portion connecting the first and second ends. The top surface is configured to engage with a first rocker arm. A recess is disposed at a top of the first end. The recess is configured to engage with a second rocker arm. A first valve seat is disposed at a bottom of the first end and includes a curved bottom surface to engage a first valve. A second valve seat is disposed at a bottom of the second end to engage a second valve.

20 Claims, 17 Drawing Sheets

VALVE BRIDGE

CROSS REFERENCE TO RELATED APPLICATION

This application is a continuation under 35 U.S.C. § 365(c) of International Patent Application No. PCT/EP2023/025460, filed on 3 Nov. 2023, which claims the benefit under 35 U.S.C. § 119(e) of U.S. Provisional Application No. 63/382,470, filed on 4 Nov. 2022, all of which are incorporated by reference herein in their entirety.

TECHNICAL FIELD

This disclosure relates generally to a valve train system, and more particularly to a valve bridge for use with a rocker arm assembly configured with engine braking functionality.

BACKGROUND

Internal combustion engines typically use either a mechanical, electrical, or hydro-mechanical valve actuation system to actuate the engine valves. These systems may include a combination of camshafts, rocker arms, and various motion-conveying mechanisms that are driven by the engine's crankshaft rotation. The timing of the valve actuation may be governed by the size and location of the lobes on the camshaft, configurations of the rocker arms, and so forth.

SUMMARY OF PARTICULAR EMBODIMENTS

This disclosure presents a valve bridge for use in a rocker arm system that is able to individually actuate a selected valve—i.e., the selected valve is actuated while unaffecting another valve. By using uniquely shaped features to engage with the rocker arms and the engine valves, the valve bridge according to this disclosure offers better motion and force transmission, maintains a more reliable contact and engagement, and optimizes overall kinematic behavior of the system. For example, contact areas of the valve bridge with the rocker arm and the engine valve, respectively, are designed with better ergonomics and are more streamlined, rendering lower contact stress and friction. Moreover, structure of the valve bridge is simplified, making the operation and production process easier and more cost-efficient.

In one embodiment, a valve bridge for a rocker arm assembly is provided. The valve bridge comprises a first end, a second end opposite to the first end, and a top surface of a bridge body portion connecting the first and second ends. The top surface of the bridge body portion is configured to engage with a first rocker arm. A first recess is disposed at a top of the first end. The first recess has a shape that is at least partially ogive and is configured to engage with a second rocker arm. A first valve seat is disposed at a bottom of the first end and includes a curved bottom surface to engage a first valve. A second valve seat is disposed at a bottom of the second end to engage a second valve. In particular, the valve bridge is configured to translate vertically upon actuation by the first rocker arm to actuate both the first and second valves, or tilt angularly upon actuation by the second rocker arm to actuate the first valve without actuating the second valve.

In particular embodiments, the engagement between the first recess and the second rocker arm forms a circular contact line. In particular embodiments, the first valve seat is a channel. In particular embodiments, the curved bottom surface of the first valve seat is S-shaped. In particular embodiments, the curved bottom surface of the first valve seat allows the first valve to shift laterally relative to the valve bridge. In particular embodiments, the second valve seat comprises a second recess. In particular embodiments, an inner diameter of the second valve seat is larger than an outer diameter of a terminal of the second valve. In particular embodiments, the second end comprises a horizontal through hole and a kinematic cylinder rotatably inserted into the horizontal through hole. In particular embodiments, the kinematic cylinder engages the second valve and maintains surface contact with the second valve as the valve bridge tilts. In particular embodiments, the top surface comprises a guide for guiding movement of the valve bridge relative to the first rocker arm.

In one embodiment, a valve bridge for a rocker arm assembly is provided. The valve bridge comprises a first end, a second end opposite to the first end, and a top surface of a bridge body portion connecting the first and second ends. The top surface of the bridge body portion is configured to engage with a first rocker arm. A protrusion is disposed at a top of the first end and is ogive in shape at a top end of the protrusion to engage with a second rocker arm. A first valve seat is disposed at a bottom of the first end and includes a curved bottom surface to engage a first valve. A second valve seat is disposed at a bottom of the second end to engage a second valve. In particular, the valve bridge is configured to translate vertically upon actuation by the first rocker arm to actuate both the first and second valves, or tilt angularly upon actuation by the second rocker arm to actuate the first valve without actuating the second valve.

In particular embodiments, the engagement between the protrusion and the second rocker arm forms a circular contact line. In particular embodiments, the protrusion is removably received by a recess disposed at the top of the first end. In particular embodiments, the curved bottom surface of the first valve seat is S-shaped. In particular embodiments, the curved bottom surface of the first valve seat allows the first valve to shift laterally relative to the valve bridge.

In one embodiment, a rocker arm assembly is provided, which comprises a first rocker arm and a second rocker arm, a first valve and a second valve, and a valve bridge configured to be selectively actuated by the first rocker arm or the second rocker arm. The valve bridge comprises a first end, a second end opposite to the first end, and a top surface of a bridge body portion connecting the first and second ends. The top surface of the bridge body portion is configured to engage with the first rocker arm. A recess is disposed at a top of the first end. The recess has a shape that is at least partially ogive and is configured to engage with a spherical end of the second rocker arm. The first valve seat is disposed at a bottom of the first end and includes a curved bottom surface to engage the first valve. A second valve seat is disposed at a bottom of the second end to engage the second valve. In particular, the valve bridge is configured to translate vertically upon actuation by the first rocker arm to actuate both the first and second valves, or tilt angularly upon actuation by the second rocker arm to actuate the first valve without actuating the second valve.

In particular embodiments, the first rocker arm is an exhaust rocker arm, and the second rocker arm is an engine brake rocker arm. In particular embodiments, the engagement between the recess and the spherical end of the second rocker arm forms a circular contact line. In particular embodiments, the second end comprises a horizontal through hole and a kinematic cylinder rotatably inserted into the horizontal through hole. In particular embodiments, the top surface comprises a guide for guiding movement of the valve bridge relative to the first rocker arm.

BRIEF DESCRIPTION OF THE DRAWINGS

Embodiments in accordance with this disclosure will now be described by reference to the accompanying drawings, in which.

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up", "down", "right", and "left" are for ease of reference to the figures and not intended to limit the scope of this disclosure.

Valve bridges may operatively couple the rocker arms and the engine valves in a way to convert rocker arm rotation to the movement of the valves to drive open the valves under control. There is a need to optimize the valve bridge design to better control valve actuation with reliable yet simplified structures. Various valve system designs have been produced in the past for use in connection with internal combustion engines for the purpose of controlling valve actuation such as for main exhaust event. Generally, in a typical valvetrain, a rocker arm system is coupled on one side to a camshaft and on the other side to a number of engine valves via a valve bridge in a way for delivering actuation motion from the camshaft to downstream valves in synchronization. In some scenarios, it may be desirable to provide auxiliary functionality, such as compression engine braking, in addition to the main lift event such that a chosen valve may be separately controlled. To achieve this, a switchable system is often employed, which can be selectively translated between a retracted and extended position, the retracted position disabling actuation of the associated valve by a corresponding rocker arm and the extended position enabling actuation of the valve. Correspondingly, the valve bridge may also be equipped with a motion-transmitting mechanism that serves to independently actuate the selected valve without affecting the others. However, current designs typically utilize complex motion components (such as a sliding component that moves up and down within the valve bridge), which introduces force balancing issues, occupies relatively large packaging space, and drives up production and material costs. Consequently, there is a need to provide a solution that is cost-efficient, easy to manufacture and use, and moreover offers desired system dynamics.

The embodiments disclosed herein present a valve bridge that addresses the above-mentioned issues by being able to rotate on demand such that the selected valve is actuated while unaffecting the other valve. By using uniquely shaped features to engage with the rocker arms and the engine valves, the valve bridge according to this disclosure offers better motion and force transmission, maintains a more reliable contact and engagement, and optimizes overall kinematic behavior of the system. Moreover, structure of the valve bridge is simplified, rendering a lower manufacturing cost, and promoting ease of operation.

Figure 1A:
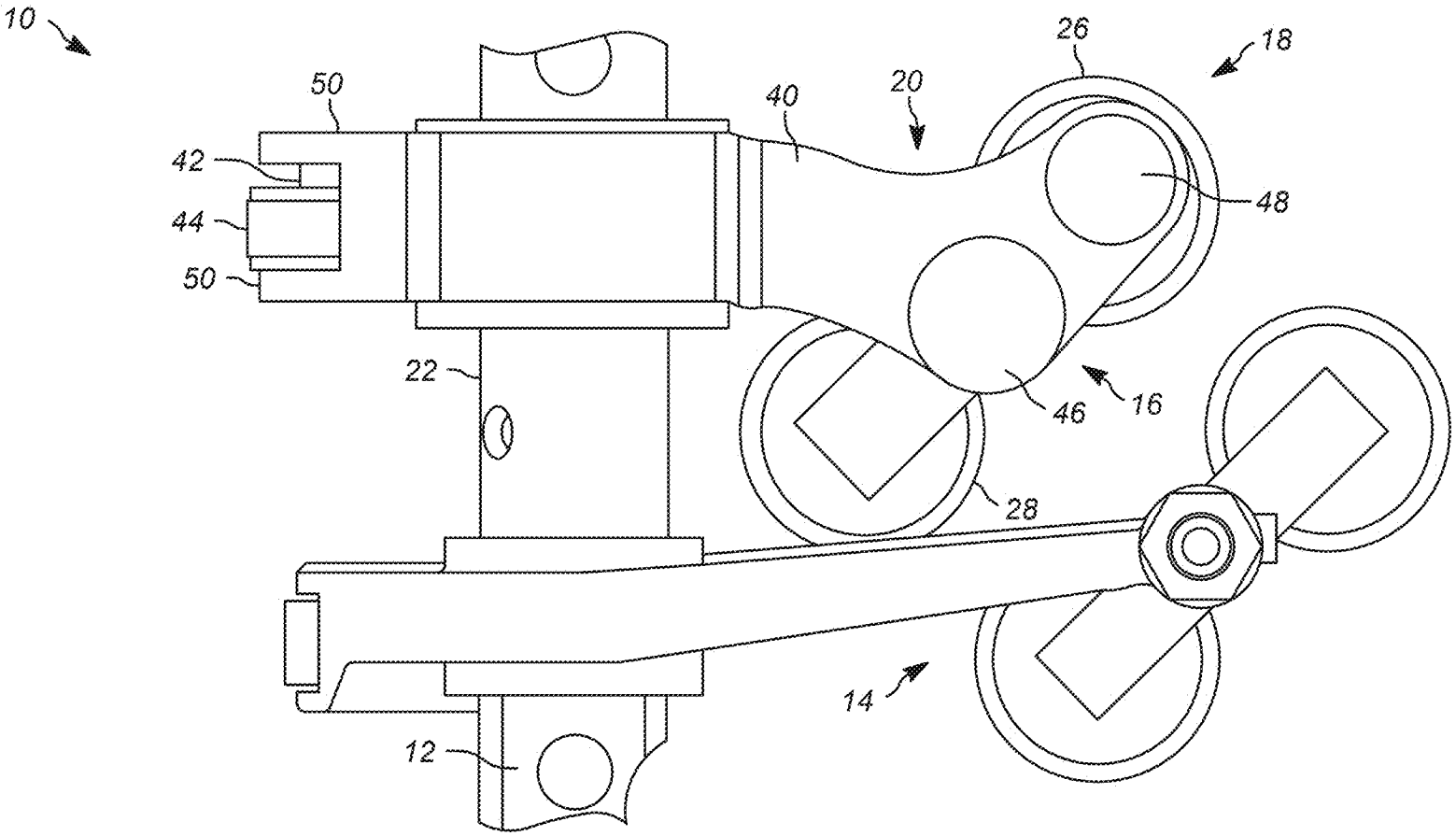
FIGS. 1A-1B illustrate different examples of a valve train assembly according to this disclosure.
Figure 1B:
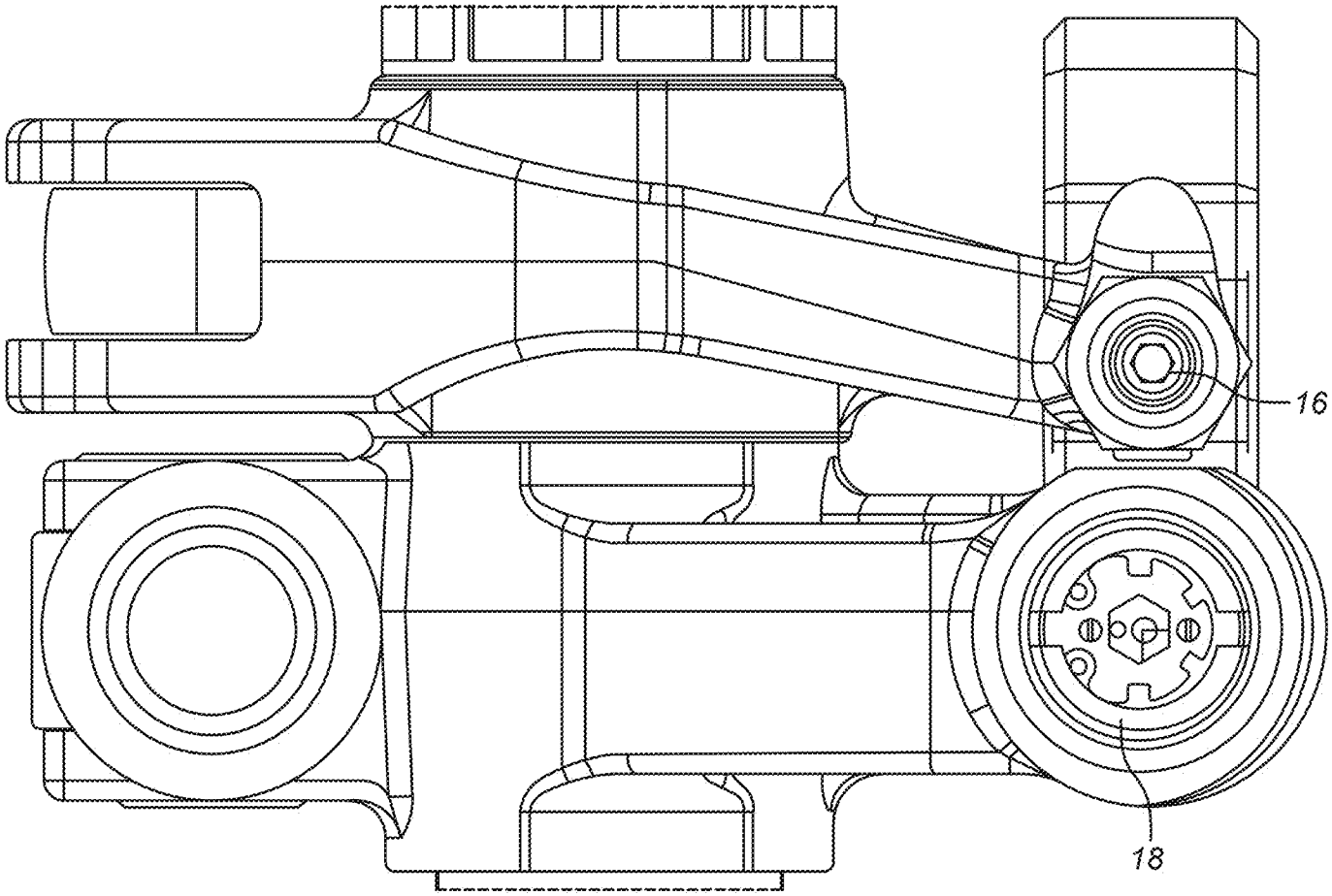

With initial reference to FIGS. 1A-1B, a valve train assembly constructed in accordance with one example of the present disclosure is partially shown and generally identified at reference 10. In particular embodiments, the valve train assembly 10 may be configured with auxiliary functionality such as engine braking and is shown as configured for use in a three-cylinder bank portion of a six-cylinder engine. Although described as such, it will be appreciated that the present disclosure is not limited thereto. In this regard, the present disclosure may be used in any valve train assembly that has auxiliary functionality.

In particular embodiments, the valve train assembly 10 may be supported by a valve train carrier 12 and may include two rocker arms per cylinder. Specifically, in particular embodiments, each cylinder may include an intake rocker arm assembly 14, an exhaust rocker arm assembly 16, and an engine brake rocker arm assembly 18. As an example and not by way of limitation, as illustrated in FIG. 1A, the exhaust rocker arm assembly 16 and the engine brake rocker arm assembly 18 may be combined into a single rocker arm body and are collectively referred to as a combined exhaust and engine brake rocker arm assembly 20, which cooperates to control opening or closing of the exhaust valves. In this case, two switchable systems (e.g., capsules or the like) may be employed to separately control exhaust and engine brake operations. As another example and not by way of limitation, as illustrated in FIG. 1B, the exhaust rocker arm assembly 16 and the engine brake rocker arm assembly 18 may be separate assemblies and may act independently from each other upon a valve bridge. In particular embodiments, the intake rocker arm assembly 14 may be configured to control motion of the intake valves in a drive mode. The exhaust rocker arm assembly 16 may be configured to control exhaust valve motion in a drive mode. The engine brake rocker arm assembly 18 may be configured to act on one of the two exhaust valves in an engine brake mode (such as a 4 mm engine brake lift), as will be described herein. In particular embodiments, each of the intake rocker arm assembly 14, exhaust rocker arm assembly 16, and engine brake rocker arm assembly 18 may be a mechanical, electrical, hydro-mechanical, or other suitable valve actuation system.

With continued reference to FIG. 1A, in particular embodiments, a rocker shaft 22 is received by the valve train carrier 12 and supports rotation of the combined exhaust and engine brake rocker arm assembly 20. As described herein in more detail, the rocker shaft 22 may communicate control fluid (e.g., oil) to the rocker arm assemblies 16, 18 during operation. A camshaft (not shown) may include lift profiles or cam lobes configured to rotate the rocker arm assemblies 16, 18 to activate first and second exhaust valves 26 and 28.

In particular embodiments, the combined rocker arm assembly 20 may generally include a rocker arm body 40, an axle 42, and a roller 44. The rocker arm body 40 may include an exhaust rocker arm portion 46 and an engine brake arm portion 48. The rocker arm body 40 may be rotatably mounted to the rocker shaft 22 and include a pair of flanges 50 to receive the axle 42 such that the roller 44 on the axle 42 is positioned at least partially between the flanges 50. The roller 44 may be configured to be engaged by an exhaust lift lobe or engine brake lobe of the camshaft. This engagement of the roller 44 causes the combined rocker arm assembly 20 to rotate according to the cam profile of the cam shaft, thereby actuating the associated valve(s) as needed. Alternatively, in other embodiments, the combined rocker arm assembly 20 may include other suitable motion-transmitting features such as a push rod that operatively couples between the rocker arm body 40 and the cam shaft for conveying valve actuation motion.

In particular embodiments, the exhaust rocker arm assembly 16 may include an exhaust rocker arm portion 46, which for example may define a bore configured to at least partially receive a hydraulic lash adjuster (HLA) assembly or exhaust capsule (not visible in FIG. 1A) having an elephant foot (E-foot) or plunger for contacting the valve bridge. As an example and not by way of limitation, when the roller 44 is engaged by an exhaust lift profile, the exhaust rocker arm portion 46 and consequently the exhaust capsule may be rotated downward, causing downward movement of the valve bridge, which in turn pushes down the first and second exhaust valve 26 and 28 associated with a cylinder of an engine (not shown). While described in this particular manner as an example, this disclosure contemplates rocker arm assemblies with or without an HLA or exhaust capsule. In this regard, for example, in embodiments where the exhaust rocker arm portion is not equipped with a capsule, a valve end or other suitable means of the rocker arm may be employed to directly or indirectly act on the valve bridge.

While particular embodiments of this disclosure may be set forth in the context of rocker arms for operating exhaust valves in an engine braking system, for example, such as for use in 1.5 or 2 stroke compression braking, it will nevertheless be appreciated by one of skill in the art that the disclosure is not limited to such an application. Various embodiments in accordance with this disclosure may be applicable to other types of systems in the valvetrain assembly. For example, embodiments of this disclosure may be used in connection with an intake rocker arm system, an extended valve closing system, an early valve opening system, or other suitable valvetrain systems as familiar to a skilled person in the art.

Figure 2:
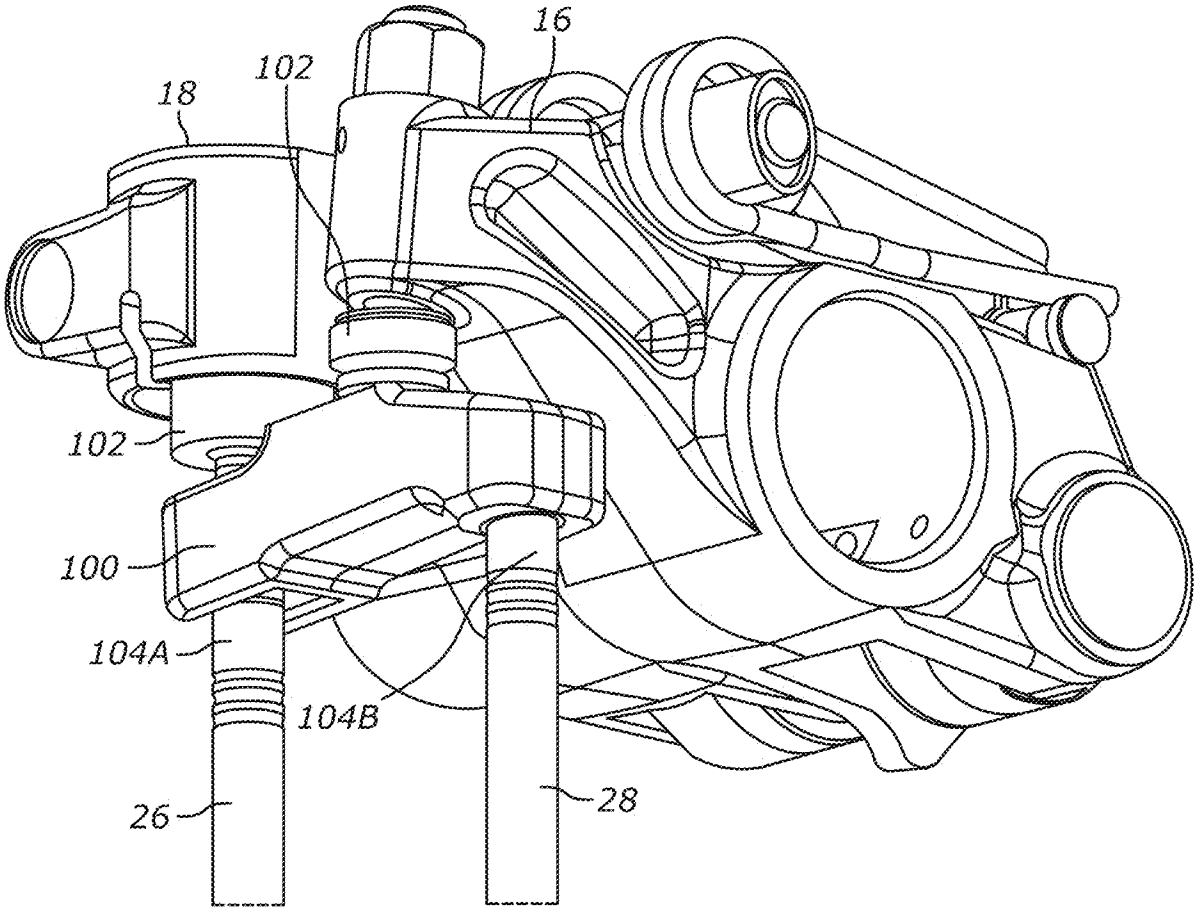
FIG. 2 illustrates a first embodiment of a valve bridge for use in a rocker arm assembly according to this disclosure.
Figure 5A:
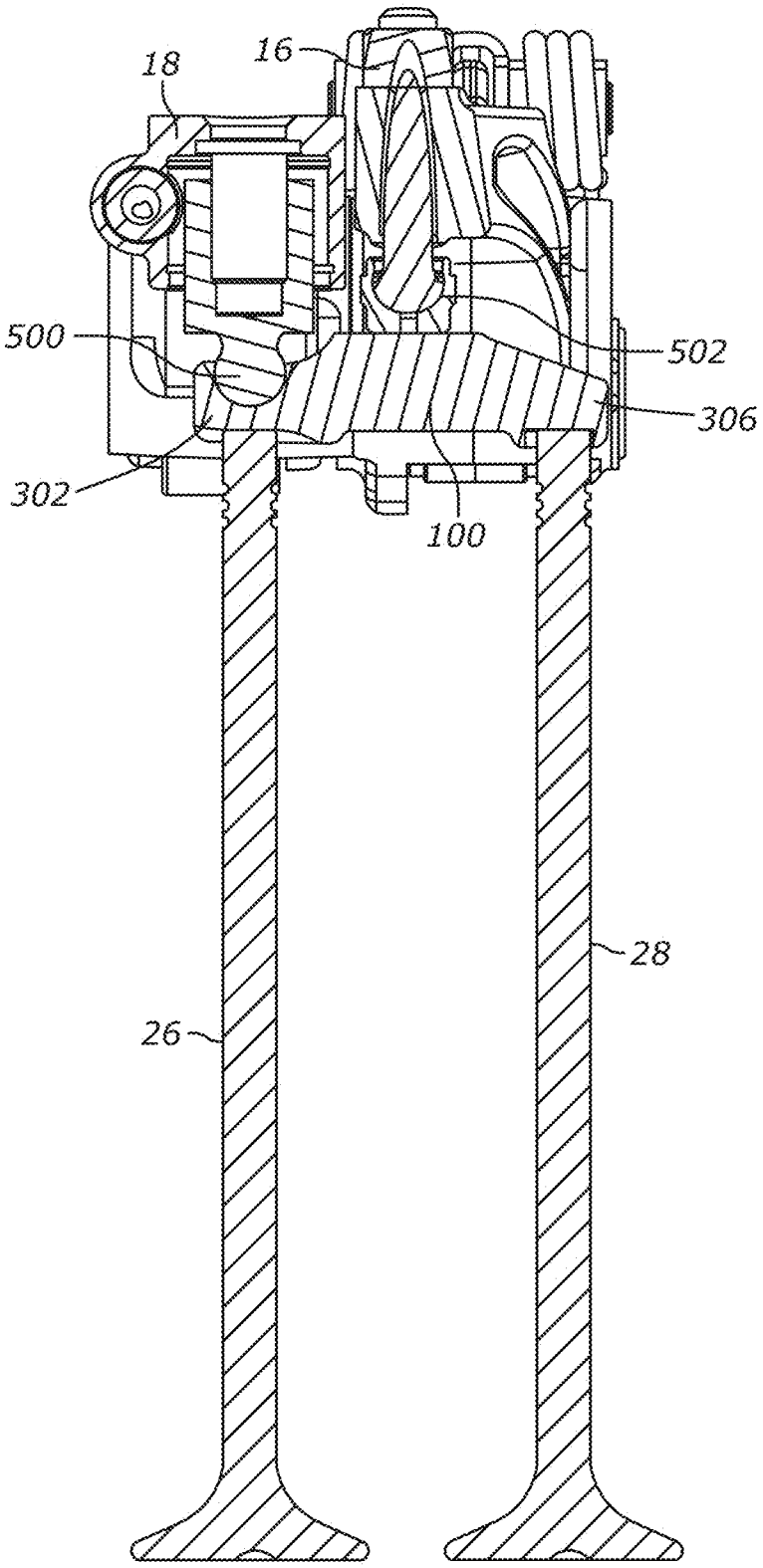
FIGS. 5A-5B illustrate the valve bridge in operation when the rocker arm assembly is in drive mode.
Figure 6A:
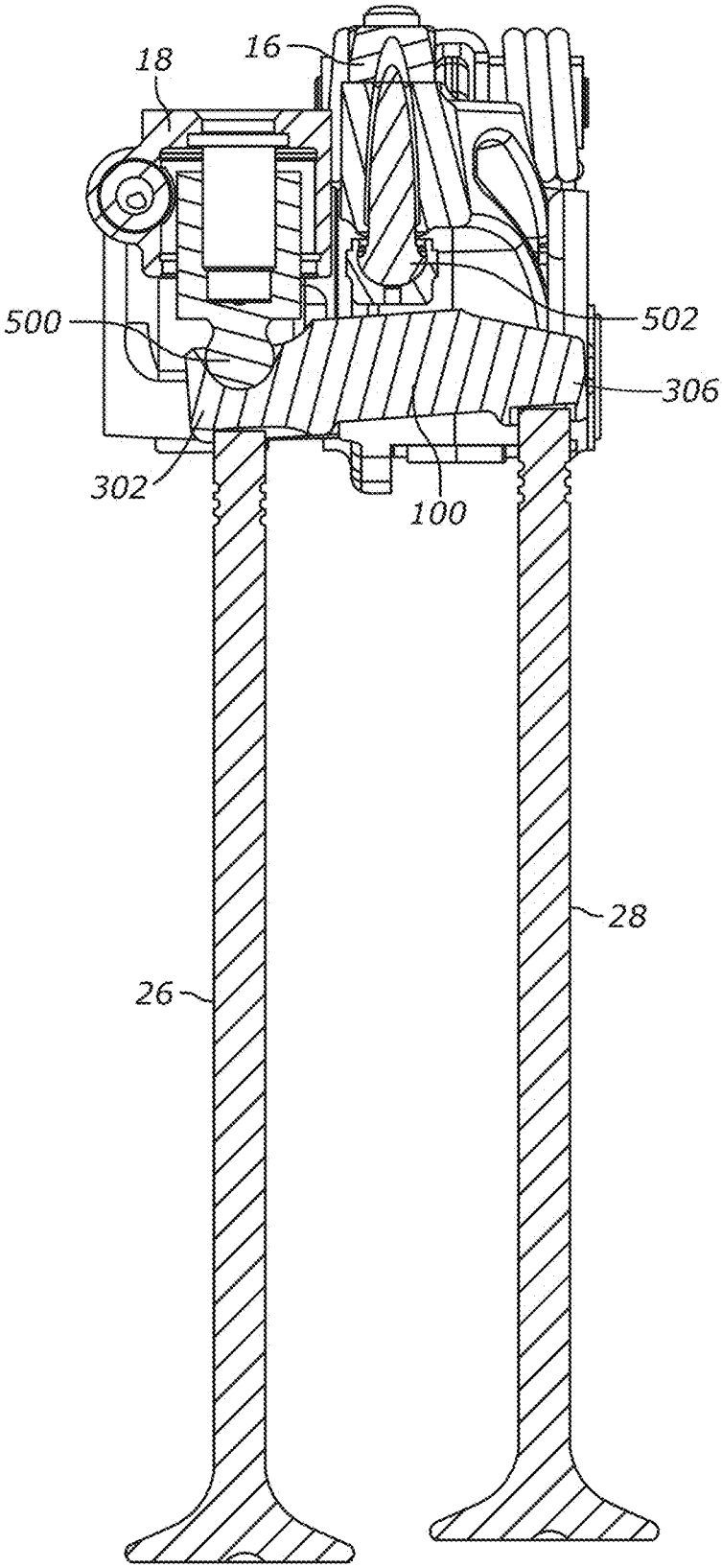
FIGS. 6A-6B illustrate the valve bridge in operation when the rocker arm assembly is in engine brake mode.

FIG. 2 illustrates a perspective view of the exhaust rocker arm assembly 16 and the engine brake rocker arm assembly 18 with a valve bridge 100 and first and second exhaust valves 26, 28 installed in place. As illustrated, the exhaust rocker arm assembly 16 and the engine brake rocker arm assembly 18 may each include a capsule assembly 102. For example, a capsule assembly 102 may be incorporated into or coupled to each of the exhaust rocker arm assembly 16 and engine brake rocker arm assembly 18 and may be configured to transfer force or motion to downstream components such as the valve bridge 100. In particular embodiments, each capsule assembly 102 may comprise a capsule (as can be seen in FIGS. 5A and 6A) operable to contact the valve bridge 100. For example, as the exhaust rocker arm assembly 16 and/or the engine brake rocker arm assembly 18 is actuated, the respective capsule may be controlled to extend and push against the valve bridge 100 so as to move the valve bridge 100. As illustrated, the valve bridge 100 may be disposed between both of the exhaust rocker arm assembly 16 and the engine brake rocker arm assembly 18 and the first and second exhaust valves 26, 28. In particular embodiments, the valve bridge 100 may be configured to receive the first and second exhaust valves 26, 28. For example, top ends 104A, 104B of the first and second exhaust valves 26, 28 may be coupled to the valve bridge 100 (e.g., to an underside of the valve bridge 100). In this way, actuation force applied to the valve bridge 100 may be transferred to the first exhaust valve 26 and/or the second exhaust valve 28, causing the first exhaust valve 26 and/or the second exhaust valve 28 to translate downwards in a vertical direction. As an example and not by way of limitation, during a first operation (e.g., in exhaust mode), both the first and second exhaust valves 26, 28 may experience the applied force and translate downwards. As another example and not by way of limitation, during a second operation (e.g., in engine brake mode), only the first exhaust valve 26 may experience the applied force and translate downwards, while the second exhaust valve 28 remains still due to tilting movement of the valve bridge 100. Particular embodiments described herein provide for an improved valve bridge 100 that may apply force to solely cause translation to the first exhaust valve 26, wherein the second exhaust valve 28 remains unactuated regardless of the motion of the valve bridge 100. Moreover, the valve bridge 100 may be configured with a simple structure that makes manufacturing easier and at the same time provides desired motion transmission.

Figure 3A:
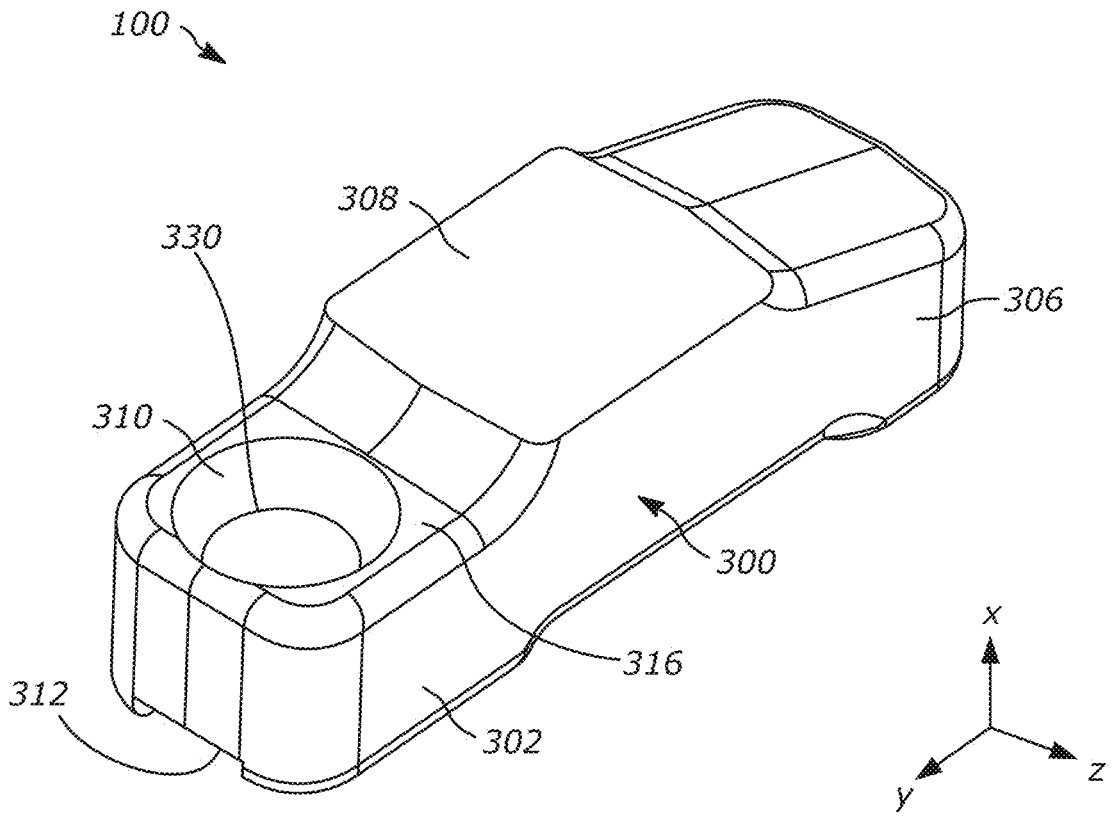
FIGS. 3A-3B illustrate perspective views of the valve bridge of FIG. 2 from the top.
Figure 3B:
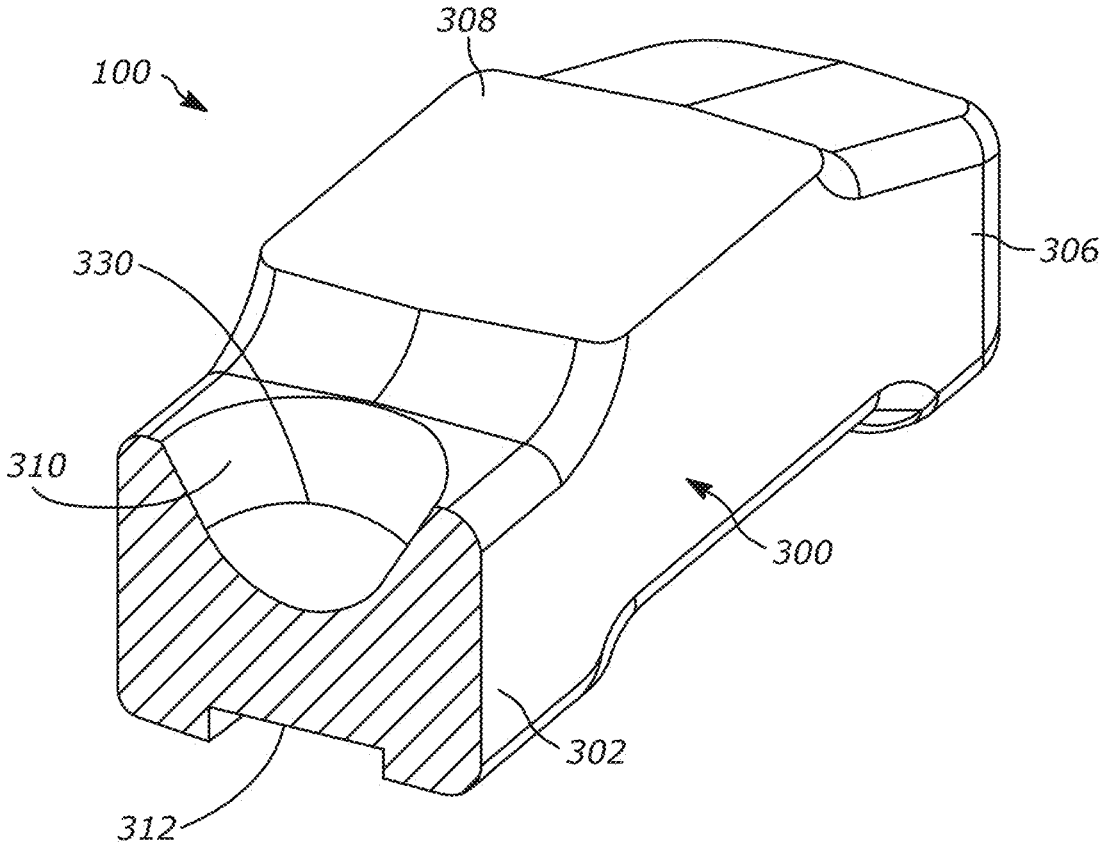

FIGS. 3A-3B illustrate top perspective views of the valve bridge 100, with portions of the valve bridge 100 cut away in FIG. 3B for better observation. In particular embodiments, the valve bridge 100 may be configured to span and sit atop the two exhaust valves (such as the first and second exhaust valves 26, 28 in FIG. 2) so as to transfer force to the exhaust valves. As illustrated, in particular embodiments, a body 300 of the valve bridge 100 may include a first end 302, a second end 306 spaced from the first end 302, and a top surface 308, with the top surface 308 connecting the first end 302 and the second end 306. As an example and not by way of limitation, the first end 302 may be operatively coupled to the terminal end of the first exhaust valve 26, and the second end 306 may be generally opposite to the first end 302 and operatively coupled to the terminal end of the second exhaust valve 28. In particular embodiments, the top surface 308 of the valve bridge 100 may be configured to couple to or engage with the exhaust rocker arm assembly 16. For example, an E-foot or a capsule of the capsule assembly 102 (referring to FIG. 2) of the exhaust rocker arm assembly 16 may rest against the top surface 308. In operation, the capsule may be actuated (e.g., based on the exhaust cam profile) to push down against the top surface 308 along a center of the valve bridge 100, thereby actuating the valve bridge 100—the valve bridge 100 in this mode translates downward while maintaining its horizontal orientation so to push down the two valves to the same lift. In the example embodiment as illustrated, the top surface 308 may generally include a flat, horizontal plane. Although described in a particular manner, the top surface 308 is not limited to this configuration. In this regard, the top surface 308 may be any suitable size and shape operable to couple to the exhaust rocker arm assembly 16.

Figure 6B:
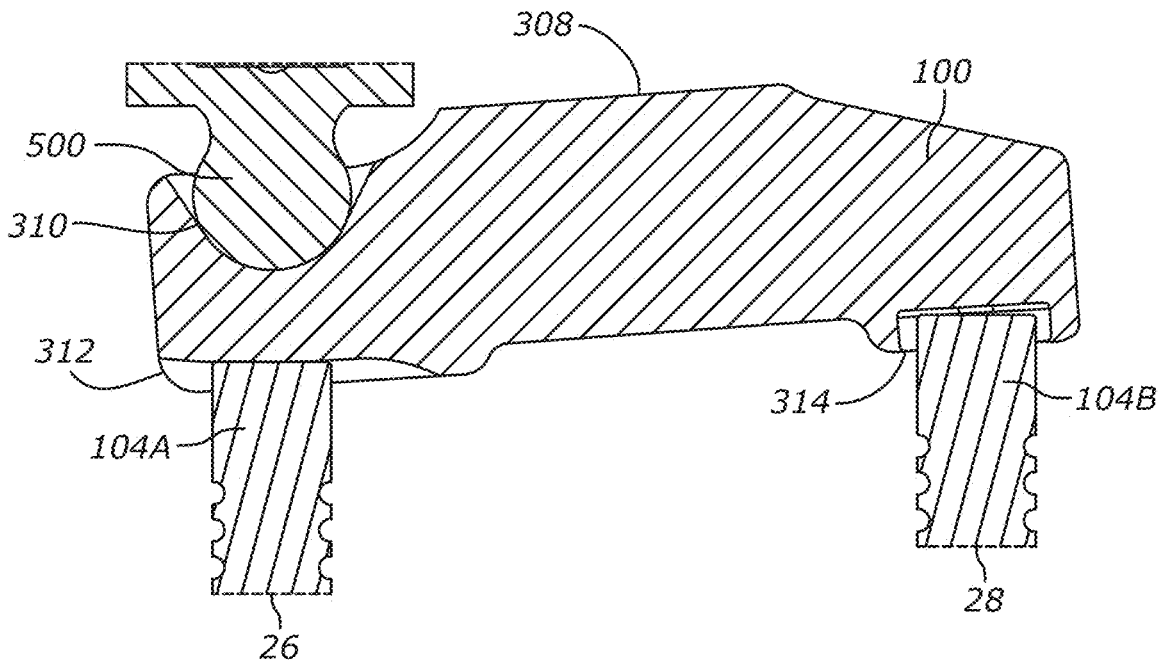

As illustrated, the body 300 may comprise a recess 310, which may be disposed at a top surface 316 of the first end 302. In particular embodiments, the recess 310 may be configured to couple to or engage with the engine brake rocker arm assembly 18. For example, in certain embodiments, the capsule assembly 102 (referring to FIG. 2) of the engine brake rocker arm assembly 18 may include an E-foot or plunger that is shaped like a ball and configured to be received at least partially by the recess 310. In operation, the E-foot may be actuated (e.g., based on the engine brake cam profile) to push down against the recess 310, thereby tilting the valve bridge 100. In the example embodiment as illustrated, the recess 310 may have a shape that is at least partially ogive. For example, the ogive may be curved to mirror or accommodate the spherical shape of the E-foot. Structured as such, contact between the valve bridge 100 and the E-foot may generally occur along a circular contact line 330. This advantageously reduces any point contact or edge-to-edge contact, resulting in lower contact stress and friction and improving the dynamic behavior of the overall system. Moreover, since the recess 310 is made to generally conform to the E-foot contour, the E-foot may be used as guidance to ensure proper position and movement of the valve bridge 100. For example, as the E-foot presses down on the valve bridge 100 via the recess 310 during engine braking, the valve bridge 100 may be actuated to move in all three x, y, and z directions relative to the valves—i.e., x- and y-direction displacement due to a downward component of the E-foot movement tilting the valve bridge 100 (e.g., as shown in FIG. 6B) and z-direction small shift due to angular rotation of the E-foot (for example, as the E-foot rotates down, the valve bridge 100 may slightly shift outward away from the rotation axis). In this case, the recess 310 may include two portions, i.e., a bottom portion (e.g., below the circular contact line 330) designed as an ogive surface to contact with the ball surface of the E-foot, and an upper portion (e.g., above the circular contact line 330) shaped as a truncated cone for guiding the E-foot at least in the x and y directions. For example, the configuration of the recess 310 may guide movement of the valve bridge 100 in all three directions so as to ensure proper alignment—for example, both as the valve bridge 100 rotates down and moves back up to its original horizontal position. It should be appreciated that although this disclosure describes a valve bridge with a particular first end in a particular manner, this disclosure contemplates valve bridges with any suitable first end in any suitable manner. In this regard, for example, in certain embodiments, the first end of the valve bridge may include other suitable structures to kinematically coordinate with the rocker arm. For example, in certain embodiments, the first end may be configured with a convex surface structure to match a concave E-foot, an example of which will be described further below.

Figure 4A:
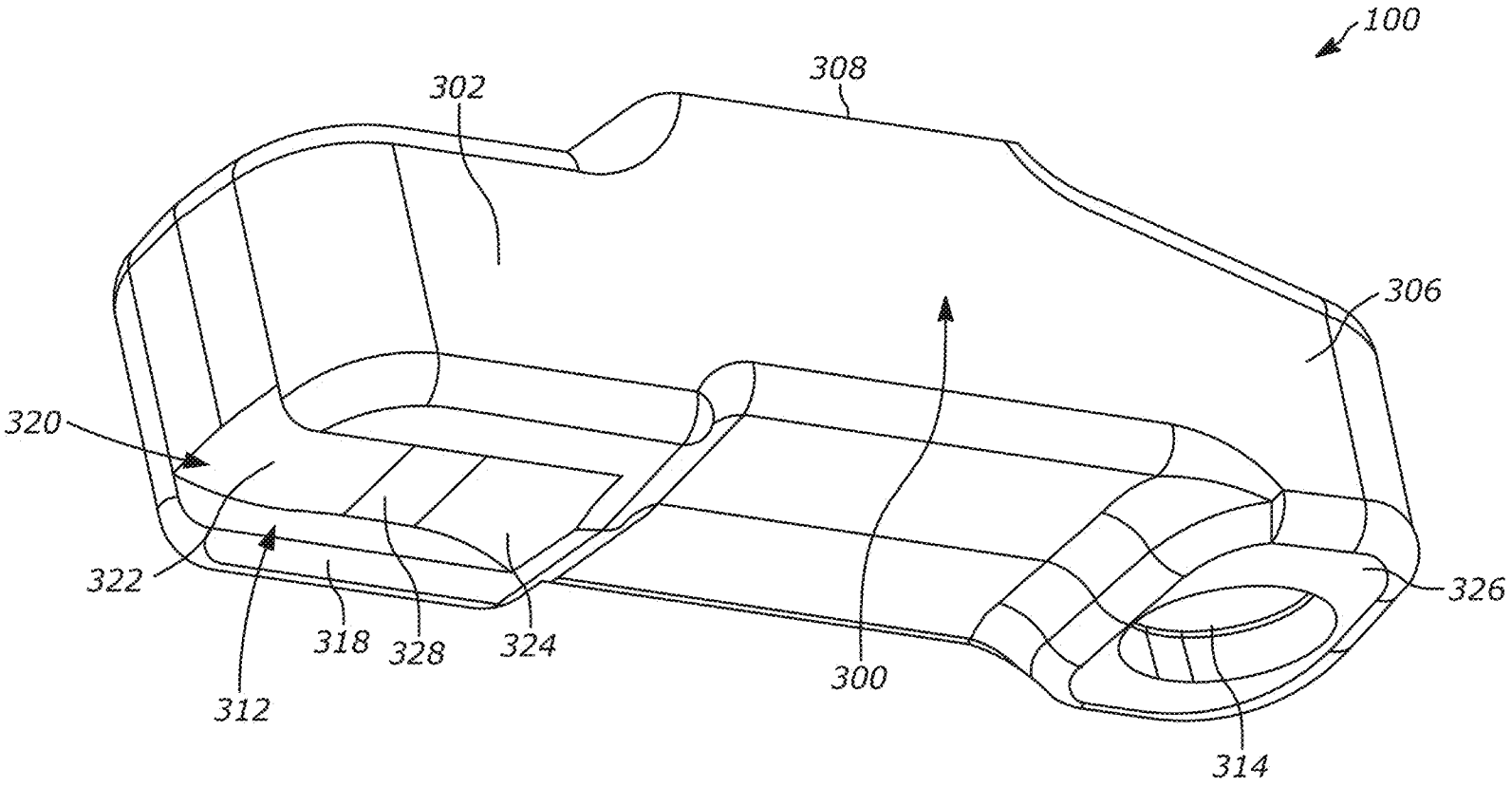
FIGS. 4A-4B illustrate perspective views of the valve bridge of FIG. 2 from the bottom.
Figure 4B:
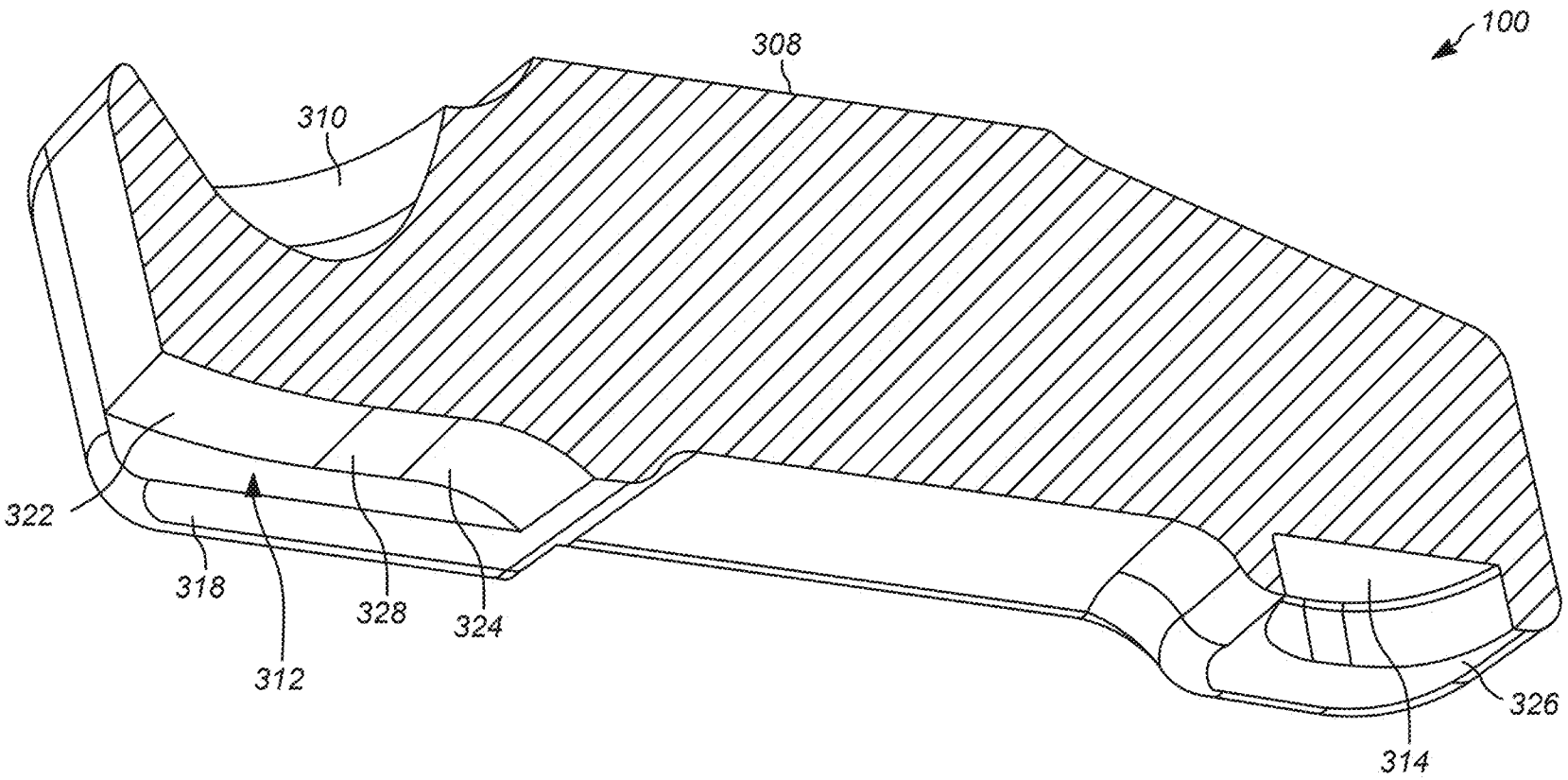

FIGS. 4A-4B illustrate bottom perspective views of the valve bridge 100, with portions of the valve bridge 100 cut away in FIG. 4B for better observation. In particular embodiments, the body 300 may also include a first valve seat 312 and a second valve seat 314. In particular embodiments, the first valve seat 312 may be disposed at a bottom surface 318 of the first end 302 and positioned generally opposite to the recess 310 along the x direction. The first valve seat 312 may be a channel to receive the first exhaust valve 26. For example, a top end 104A (referring to FIG. 2) of the first exhaust valve 26 may sit in the first valve seat 312, contacting against a contact surface 320 at the bottom of the first valve seat 312. In particular embodiments, the contact surface 320 may be shaped with a S-like curvature. As an example and not by way of limitation, the contact surface 320 may include a generally flat portion 328 transitioning between a first curvilinear portion 322 and a second curvilinear portion 324. As illustrated, the first curvilinear portion 322 may face a direction opposite to the second curvilinear portion 324. For example, the unit normal vector of the first curvilinear portion 322 may point generally upward while the unit normal vector of the second curvilinear portion 324 may point generally downward. As another example, the curvature of the first curvilinear portion 322 may be the same as or different from the curvature of the second curvilinear portion 324. In this way by curving the contact surface 320, constant line or surface contact with the associated valve may be maintained as the valve bridge 100 tilts or translates. In an alternative embodiment, the contact surface 320 may have a first curved surface having a first radius and a second curved surface having a second radius. Additionally, a flat surface may be configured between the first curved surface and the second curved surface. For example, a center of curvature of the first curved surface may locate above the first curved surface, while a center of curvature of the second curved surface may locate below the second curved surface. As another example, the first radius may be the same as or different from the second radius. In particular embodiments, point contact or edge-to-edge contact may be eliminated or at least reduced so as to improve system kinematics. This also facilitates machining of the valve bridge and provides better structural ergonomics.

In particular embodiments, the second valve seat 314 may be disposed at a bottom surface 326 of the second end 306 and positioned generally opposite to the first valve seat 312 along the y direction. The second valve seat 314 may be a recess to receive the second exhaust valve 28. For example, a top end 104B (referring to FIG. 2) of the second exhaust valve 28 may fit in the second valve seat 314, contacting against a contact surface at the bottom of the second valve seat 314. The contact surface may be flat or otherwise curved. As illustrated, the second valve seat 314 may generally be circular in shape in the x-y plane. In particular embodiments, the circular shape of the second valve seat 314 may be suitable to accommodate the shape of the top end 104B of the second exhaust valve 28. As a non-limiting example, the inner diameter of the second valve seat 314 may be slightly larger than the outer diameter of the top end 104B of the second exhaust valve 28 such that a radial clearance is formed between the second valve seat 314 and the second exhaust valve 28. This configuration may allow for movement (e.g., tilting) of the valve bridge 100 relative to the second exhaust valve 28 while ensuring proper motion and/or force transmission when needed. While described in this particular manner, it should be understood that the second valve seat 314 is not limited to this configuration. The second valve seat 314 may be any suitable size and shape as familiar to those skilled in the art for receiving the top end 104B of the second exhaust valve 28.

Figure 5B:
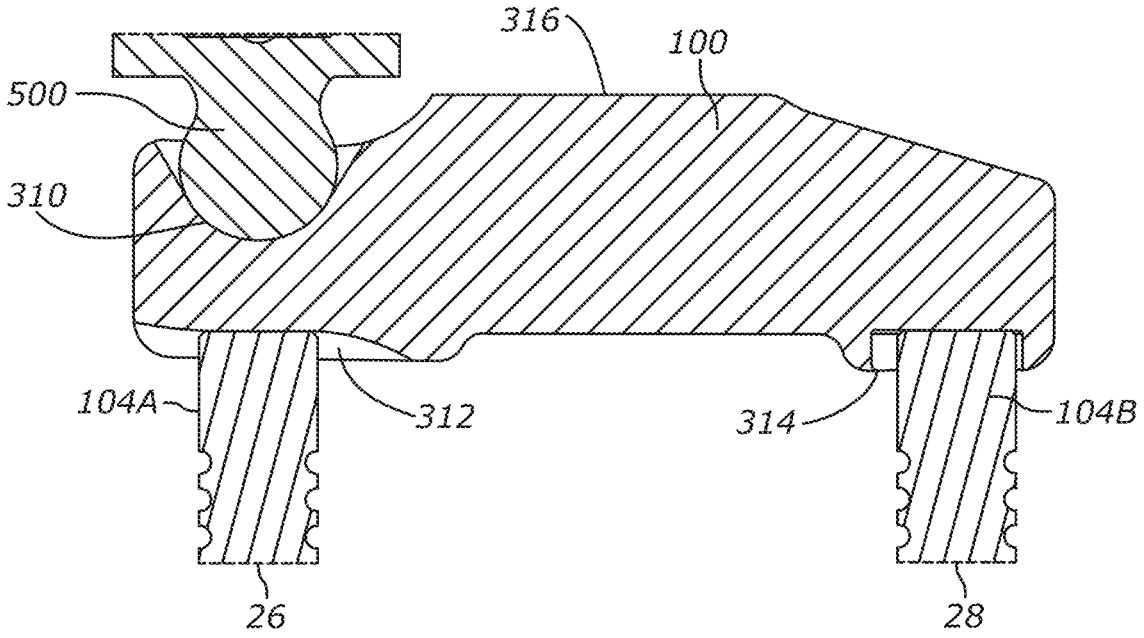

Operation of the valve bridge 100 in accordance with this disclosure will now be explained with reference to FIGS. 5A-6B, in which FIGS. 5A-5B illustrate a side view of both the exhaust rocker arm assembly 16 and engine brake rocker arm assembly 18 in a first position (e.g., in drive mode), and FIGS. 6A-6B illustrate a side view of both the exhaust rocker arm assembly 16 and engine brake rocker arm assembly 18 in a second position (e.g., in engine brake mode).

Referring to FIGS. 5A-5B, for example, in drive mode, the exhaust rocker arm assembly 16 may rock (e.g., responsive to a main lift profile of the cam) and act on the valve bridge 100 by pressing against the top surface 308 of the valve bridge 100 so as to push the valve bridge 100 vertically downward. As this occurs, both of the first and second exhaust valves 26 and 28 may be driven open simultaneously. In other words, in drive mode, a horizontal or longitudinal axis of the valve bridge 100 may remain substantially perpendicular to the vertical axes of both the first and second exhaust valves 26 and 28 as the valve bridge 100 is driven down and open the first and second exhaust valves 26 and 28 to the same valve position.

In addition, when in drive mode, the engine brake rocker arm assembly 18 may be on base circle or deactivated. Alternatively or additionally, the first capsule 500 associated with the engine brake rocker arm assembly 18 may be deactivated in order to refrain from conveying any actuation force or motion down to the valve bridge 100 even if the engine brake rocker arm assembly 18 rotates such that the valve bridge 100, specifically the recess 310, receives zero actuation motion from the engine brake rocker arm assembly 18. Although the first capsule 500 is depicted as being seated within the recess 310 during drive mode, other configurations of the first capsule 500 are also envisioned. For example, the first capsule 500 may be caused to retract upward (for example, by controlling a switchable system of the first capsule 500) to avoid contacting the valve bridge 100.

Referring to FIGS. 6A-6B, for example, in engine brake mode, the exhaust rocker arm assembly 16 may be on base circle or deactivated. Alternatively or additionally, the second capsule 502 associated with the exhaust rocker arm assembly 16 may be deactivated in order to refrain from conveying any actuation force or motion down to the valve bridge 100 even if the exhaust rocker arm assembly 16 rotates such that the valve bridge 100, specifically the top surface 308, receives zero actuation motion from the exhaust rocker arm assembly 16. For example, as depicted, the second capsule 502 may be spaced from contacting the top surface 308. Alternatively, the second capsule 502 may switch to be retractable, e.g., by means of lost motion mechanisms or other suitable features as familiar to those skilled in the art.

In addition, when in engine brake mode, the engine brake rocker arm assembly 18 may rotate according to the lift profile of an engine brake cam. Furthermore, the first capsule 500 is controlled to extend such that the E-foot may push on the first end 302 in order to convey motion to the first exhaust valve 26 independently from the second exhaust valve 28. That is, the second exhaust valve 28 remains unactuated regardless of movement of the engine brake rocker arm assembly 18. During the engine brake event, the valve bridge 100 may be tilted or pivot a certain angular degree with the first end 302 moving downward, e.g., generally around the top end 104B of the second exhaust valve 28. In other words, the first end 302 may travel down, pushing the first exhaust valve 26 to open, while the second end 306 generally remain at the same position without actuating the second exhaust valve 28.

In particular embodiments, as the valve bridge 100 tilts, slight drift may occur, which causes displacement of the top end 104A of the first exhaust valve 26 within the first valve seat 312. For example, the top end 104A may initially be disposed against the flat portion 328 of the first valve seat 312. The drift may displace the top end 104A to move to the left of the flat portion 328 towards the first curvilinear portion 322. In these embodiments, thanks to the shape of the first valve seat 312, desired force transmission may be maintained—the force applied to the first exhaust valve 26 may still be approximately the same force as the force applied by the first capsule 500—despite the drift of position of the first exhaust valve 26 relative to the first valve seat 312.

In particular embodiments, the second valve seat 314 may also be configured to accommodate the drift. As an example and not by way of limitation, as discussed above, the second valve seat 314 may have an inner diameter larger than the outer diameter of the top end 104B of the second exhaust valve 28 such that the second exhaust valve 28 may shift (e.g., to the left as shown) inside the second valve seat 314. Moreover, depth of the second valve seat 314 may be designed deep enough such that at least a portion of the top end 104B of the second exhaust valve 28 is always contained within the second valve seat 314 as the valve bridge 100 tilts. This avoids dislodging of the second exhaust valve 28 from the valve bridge 100.

In particular embodiments, the engine brake lift may be about 4 mm. As the first capsule 500 actuates to apply a downward force, the valve bridge 100 may tilt down, overcoming a biasing force of a valve spring (not shown) coupled to the first exhaust valve 26 to lift the first exhaust valve 26 about 4 mm from the valve seat (not shown). In the meantime, due to tilting of the valve bridge 100, force conveyed to the second exhaust valve 28 may be kept minimal or at least small enough as compared to the biasing spring force such that the second exhaust valve 28 does not translate vertically. As an example and not by way of limitation, the first exhaust valve 26 may experience 10 kN and the second exhaust valve 28 may experience 0.5 kN. It should be appreciated that the embodiments provided herein are for the purpose of explanation only and are not intended to limit the scope of this disclosure. For example, in certain embodiments, the engine brake lift may be about 2 mm. In other embodiments, the engine brake lift may be less than 4 mm, more than 4 mm, or other suitable values. In further embodiments, force experienced by the first or second exhaust valve may be less than or greater than the values described above.

Figure 7:
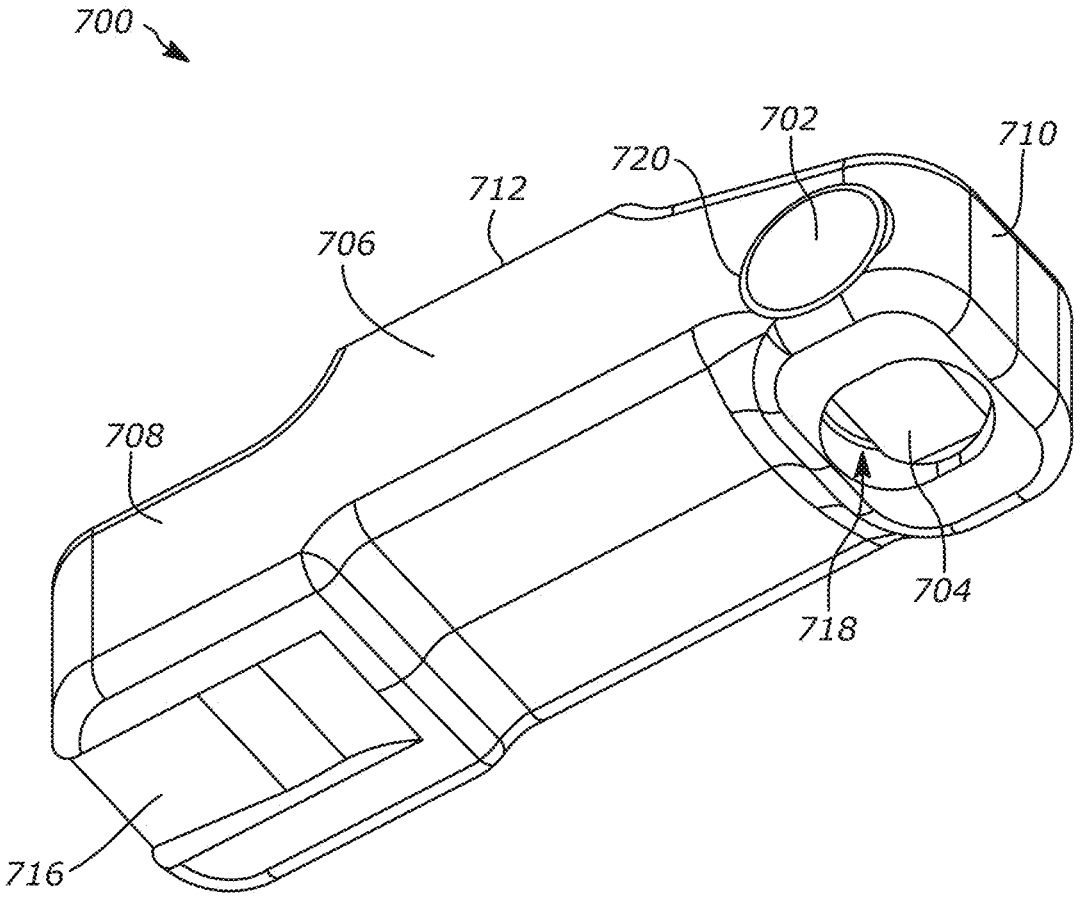
FIGS. 7-8 illustrate a second embodiment of a valve bridge for use in a rocker arm assembly according to this disclosure.
Figure 8:
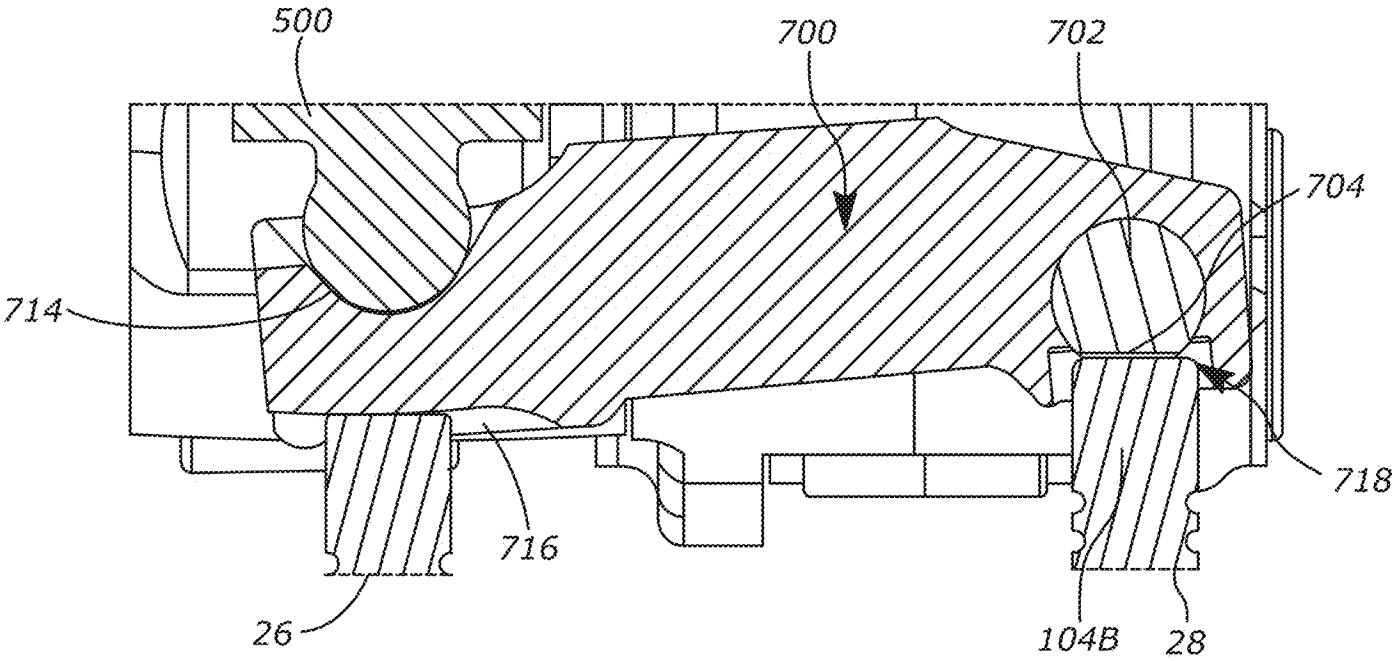

FIGS. 7-8 illustrate a second embodiment of a valve bridge according to this disclosure, in which FIG. 7 shows a perspective view of the valve bridge 700, and FIG. 8 is a side cross-sectional view of the valve bridge 700 during operation. In particular embodiments, the valve bridge 700 may operate similarly to the valve bridge 100 in that the valve bridge 700 may tilt upon actuation by the engine brake rocker arm assembly 18 so as to press open the first exhaust valve 26 separately from the second exhaust valve 28. Further, the valve bridge 700 may be configured with similar structures as the valve bridge 100, including the body 706 having the first end 708, the second end 710, the top surface 712, the recess 714, the first valve seat 716, and the second valve seat 718. In the illustrated embodiment, the valve bridge 700 may also include a kinematic cylinder 702, which may be rotatably disposed through a hole 720 at the second end 710 along the z-direction. Further, the second valve seat 718 may open into the hole 720, providing access to the kinematic cylinder 702 inserted through the hole 720. As an example and not by way of limitation, the kinematic cylinder 702 may substantially be cylindrical in shape and have a flat surface 704 at the bottom. The flat surface 704 may be exposed by the second valve seat 718 such that the top end 104B of the second exhaust valve 28 may pass through the second valve seat 718 and contact the flat surface 704. In particular embodiments, the kinematic cylinder 702 may be used to improve the overall system kinematic and increase the contact between the second exhaust valve 28 and the valve bridge 700. For example, as the valve bridge 700 rotates during engine brake mode, the kinematic cylinder 702 may rotate relative to the body 706 such that the flat surface 704 may maintain a large contact area with the top end 104B of the second exhaust valve 28 and help prevent point contact that may otherwise occur due to tilting of the valve bridge 700. This may be especially useful for systems with lost motion components associated with the exhaust rocker arm assembly 16 that may affect main exhaust contact area between the second capsule 502 and the top surface 712 of the valve bridge 700, e.g., due to two stroke engine brake.

Figure 9:
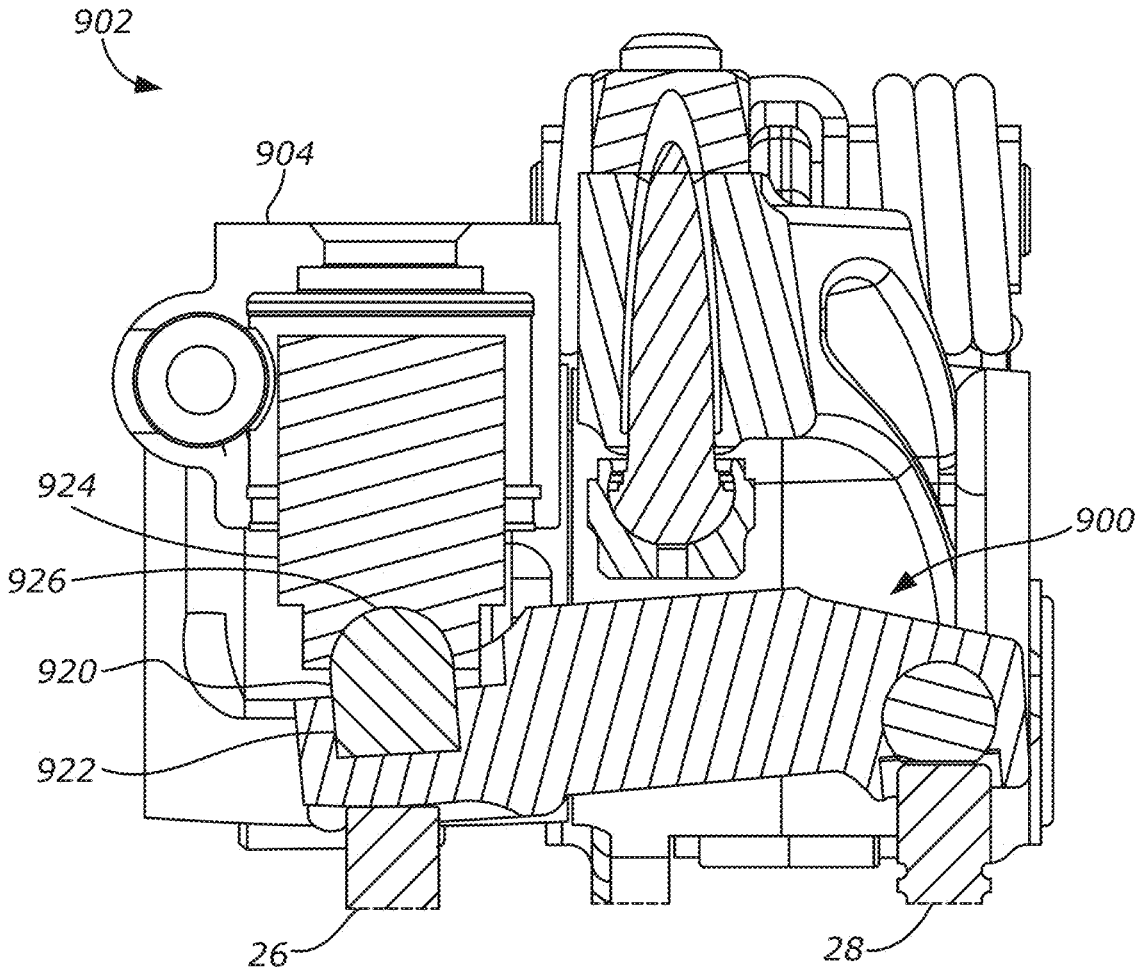
FIGS. 9-10 illustrate a third embodiment of a valve bridge for use in a rocker arm assembly according to this disclosure.
Figure 10:
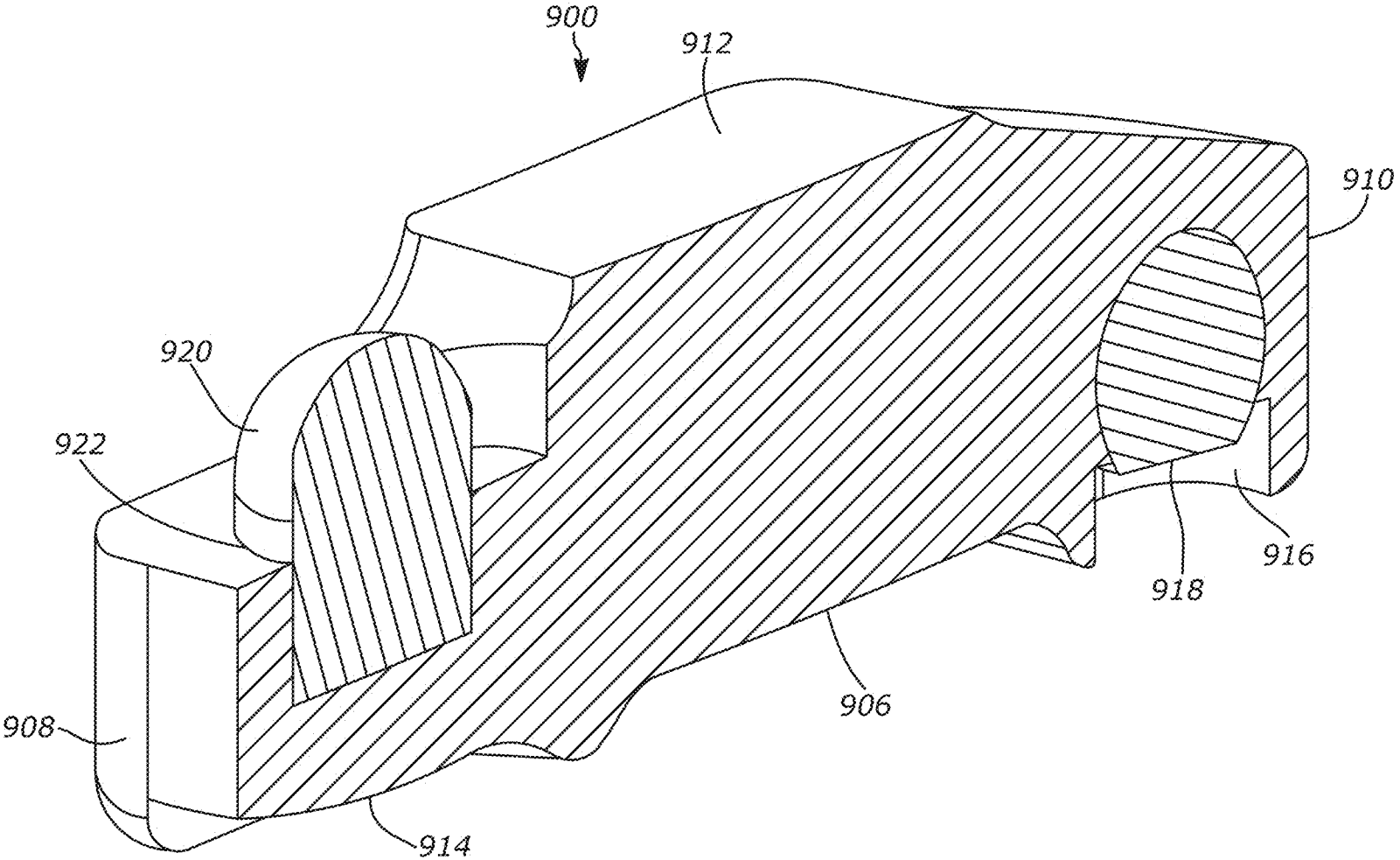

FIGS. 9-10 illustrate a third embodiment of a valve bridge according to this disclosure, in which FIG. 9 shows a cross-sectional view of the valve bridge 900 used in a rocker arm assembly 902 during engine braking, and FIG. 10 is a cross-sectional perspective view of the valve bridge 900. In particular embodiments, the valve bridge 900 may operate similarly to the valve bridge 700 in that the valve bridge 900 may tilt upon actuation by the engine brake rocker arm assembly 904 so as to press open the first exhaust valve 26 separately from the second exhaust valve 28. Further, the valve bridge 900 may be configured with similar structures as the valve bridge 700, including the body 906 having the first end 908, the second end 910, the top surface 912, the first valve seat 914, the second valve seat 916, and the kinematic cylinder 918. In the illustrated embodiment, the valve bridge 900 may further include a knob 920, which may be attached on the top of the first end 908. As illustrated, the knob 920 may include a protrusion at the top end of the knob 920 and the protrusion may be ball-shaped, ogive-shaped, or otherwise rounded. For example, the bottom of the knob 920 may be received by a recess 922 on the top surface of the first end 908 and extend upward to a certain height above the top surface of the first end 908. In order to engage with the knob 920, the capsule assembly 924 of the engine brake rocker arm assembly 904 may be configured with a recess or concave surface 926 that is shaped to fit to the protrusion at the top end of the knob 920. Explaining further, configurations of the valve bridge 900 and the engine brake rocker arm assembly 904 are reversed regarding to the positions of the recess and the corresponding mating structure (e.g., the E-foot or the knob 920) as compared to the embodiments explained above with reference to FIGS. 1-8, for example. In particular embodiments, in addition to the aforementioned benefit of optimizing system kinematics, the height of the knob 920 advantageously may be adjustable depending on packaging requirements. This may be especially useful when a different space for the capsule assembly 924 is needed. As an example and not by way of limitation, the knob 920 may be removably received by the recess 922. As such, when a different height is required, the knob 920 may be easily removed and replaced without having to change the entire valve bridge 900.

Figure 11:
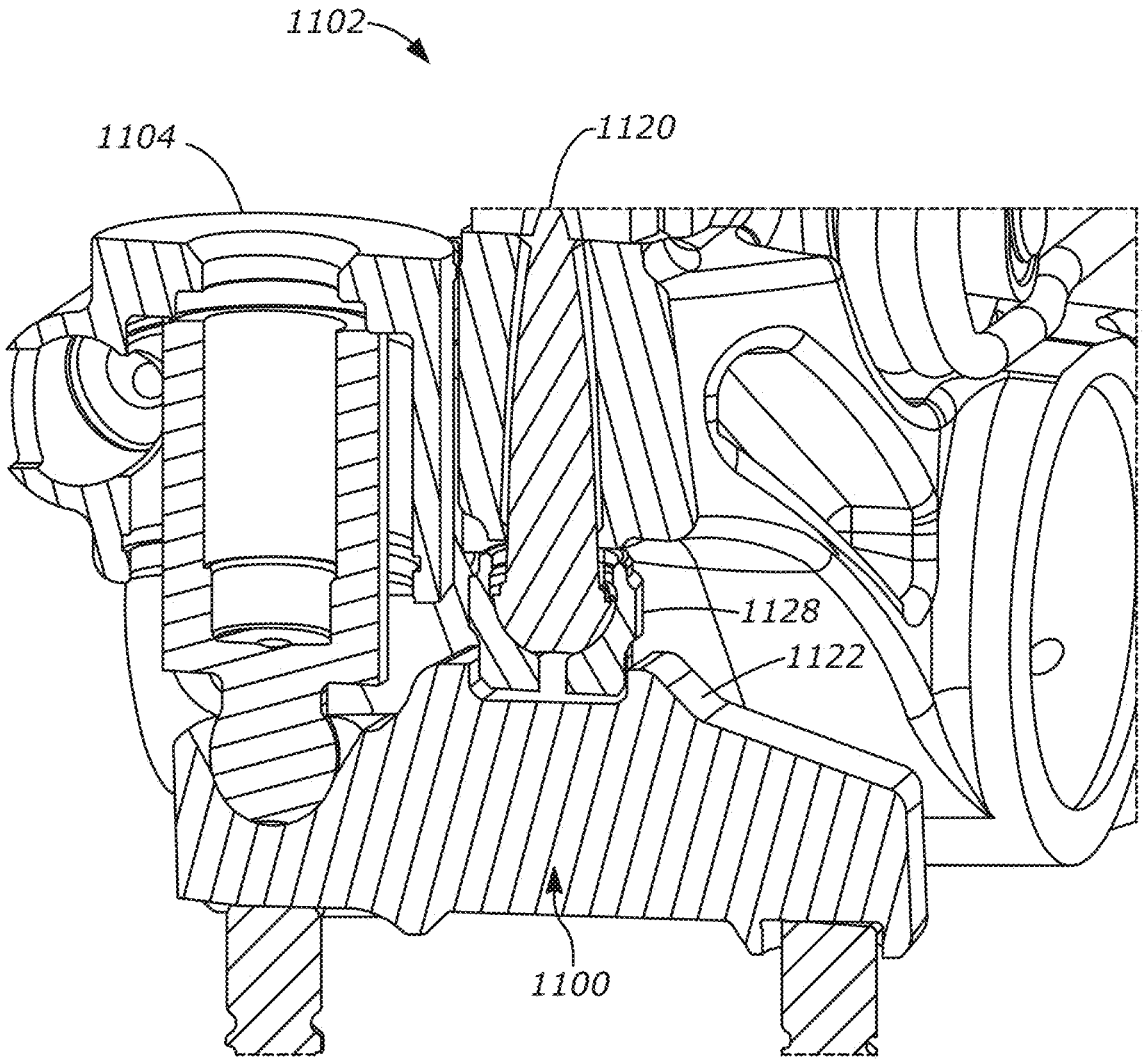
FIGS. 11-12 illustrate a fourth embodiment of a valve bridge for use in a rocker arm assembly according to this disclosure.
Figure 12:
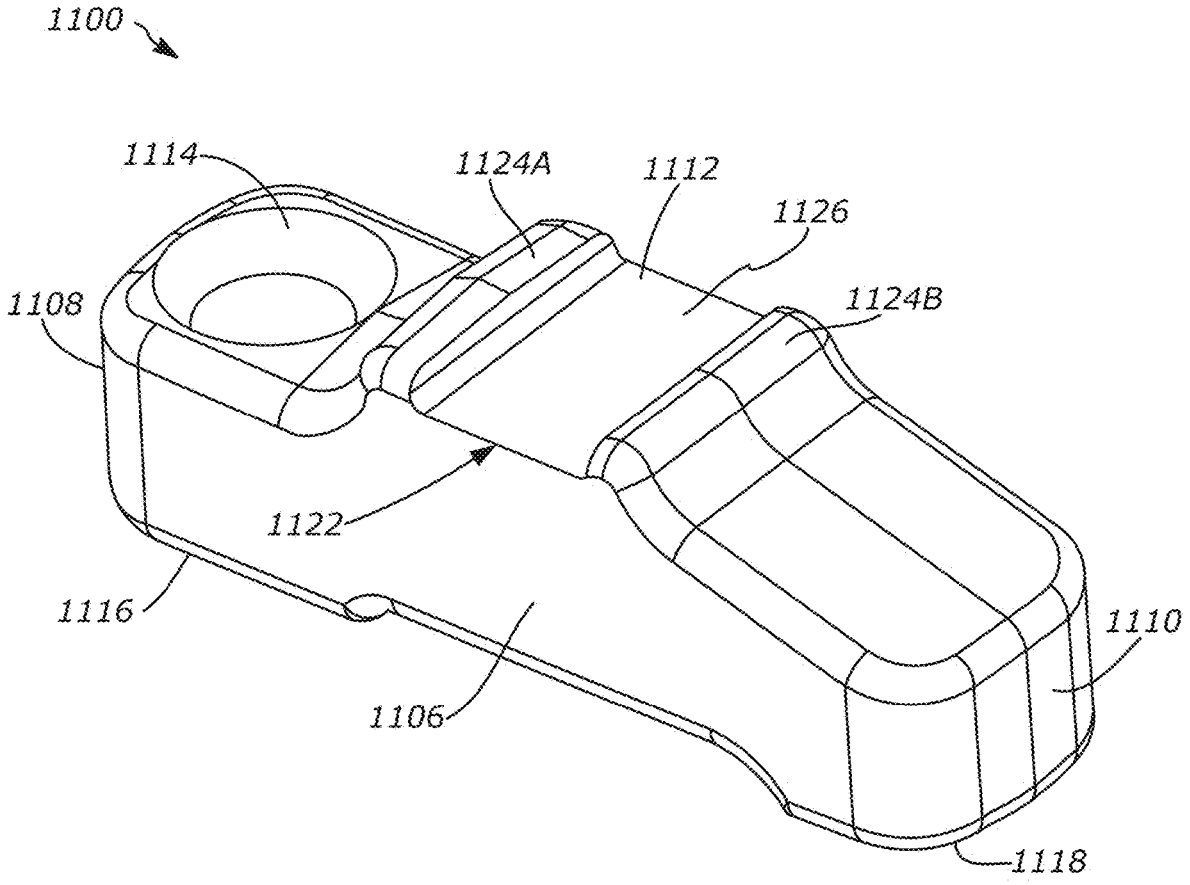

FIGS. 11-12 illustrate a fourth embodiment of a valve bridge according to this disclosure, in which FIG. 11 shows a cross-sectional view of the valve bridge 1100 used in a rocker arm assembly 1102 during engine braking, and FIG. 12 is a perspective view of the valve bridge 1100. In particular embodiments, the valve bridge 1100 may operate similarly to the valve bridge 100 in that the valve bridge 1100 may tilt upon actuation by the engine brake rocker arm assembly 1104 so as to press open the first exhaust valve 26 separately from the second exhaust valve 28. Further, the valve bridge 1100 may be configured with similar structures as the valve bridge 100, including the body 1106 having a first end 1108, a second end 1110, a top surface 1112, a recess 1114, a first valve seat 1116, and a second valve seat 1118. In the illustrated embodiment, the top surface 1112 may also be provided with surface structures for guiding the position or movement of the valve bridge 1100 when actuated by the exhaust rocker arm assembly 1120. As an example and not by way of limitation, a guide 1122 may be provided on the top surface 1112, which may be formed as a slot, a channel, a protrusion, or other suitable features to engage with the exhaust rocker arm assembly 1120. In the embodiment as illustrated, the guide 1122 includes a pair of walls 1124A and 1124B extending across the entire width of the valve bridge 1100 and defines a channel 1126 therebetween to receive the E-foot 1128 of the exhaust rocker arm assembly 1120. During operation, undesirable drift of the valve bridge may occur, causing the valve bridge to be misaligned relative to the exhaust rocker arm assembly. The guide 1122 in this scenario may prevent the valve bridge 1100 from shifting along a lateral direction and maintain proper orientation and position with respect to the exhaust rocker arm assembly 1120.

Various embodiments of this disclosure may advantageously provide an optimized solution for coupling between the rocker arms and the valves to allow for improved motion and force transmission. By employing the novel designs according to this disclosure, the valve bridge may achieve better kinematic behavior with simplified structures and reduced packaging space. One or more other advantages may be readily apparent to one skilled in the art in view of the figures, descriptions, and claims of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

The invention claimed is:

1. A valve bridge for a rocker arm assembly, the valve bridge comprising:

a first end, a second end opposite to the first end, and a top surface of a bridge body portion connecting the first and second ends, wherein the top surface of the bridge body portion is configured to engage with a first rocker arm;

a first recess disposed at a top of the first end, wherein the first recess is configured to engage with a second rocker arm;

a first valve seat disposed at a bottom of the first end and having a curved bottom surface to engage a first valve, the first valve seat forming a channel extending longitudinally toward the second end; and a second valve seat disposed at a bottom of the second end to engage a second valve;

wherein the valve bridge is configured to:

translate vertically upon actuation by the first rocker arm to actuate both the first and second valves, or tilt angularly upon actuation by the second rocker arm to actuate the first valve without actuating the second valve.

2. The valve bridge of claim 1, wherein the first recess has a shape that is at least partially ogive, and wherein the engagement between the first recess and the second rocker arm forms a circular contact line.

3. The valve bridge of claim 1, wherein the curved bottom surface of the first valve seat is S-shaped.

4. The valve bridge of claim 1, wherein the curved bottom surface of the first valve seat allows the first valve to shift laterally relative to the valve bridge.

5. The valve bridge of claim 1, wherein the second valve seat comprises a second recess.

6. The valve bridge of claim 1, wherein an inner diameter of the second valve seat is larger than an outer diameter of a terminal of the second valve.

7. The valve bridge of claim 1, wherein the second end comprises a horizontal through hole and a kinematic cylinder rotatably inserted into the horizontal through hole.

8. The valve bridge of claim 7, wherein the kinematic cylinder engages the second valve and maintains surface contact with the second valve as the valve bridge tilts.

9. The valve bridge of claim 1, wherein the top surface comprises a guide for guiding movement of the valve bridge relative to the first rocker arm.

10. A valve bridge for a rocker arm assembly, the valve bridge comprising:

a first end, a second end opposite to the first end, and a top surface of a bridge body portion connecting the first and second ends, wherein the top surface of the bridge body portion is configured to engage with a first rocker arm;

a protrusion disposed at a top of the first end and configured to engage with a second rocker arm;

a first valve seat disposed at a bottom of the first end and having a curved bottom surface to engage a first valve, the first valve seat forming a channel extending longitudinally toward the second end; and a second valve seat disposed at a bottom of the second end to engage a second valve, wherein the valve bridge is configured to:

translate vertically upon actuation by the first rocker arm to actuate both the first and second valves, or tilt angularly upon actuation by the second rocker arm to actuate the first valve without actuating the second valve.

11. The valve bridge of claim 10, wherein the protrusion is at least partially ogive in shape at a top end of the protrusion, and wherein the engagement between the protrusion and the second rocker arm forms a circular contact line.

12. The valve bridge of claim 10, wherein the protrusion is removably received by a recess disposed at the top of the first end.

13. The valve bridge of claim 10, wherein the curved bottom surface of the first valve seat is S-shaped.

14. The valve bridge of claim 10, wherein the curved bottom surface of the first valve seat allows the first valve to shift laterally relative to the valve bridge.

15. A rocker arm assembly, comprising:

a first rocker arm and a second rocker arm;

a first valve and a second valve; and a valve bridge configured to be selectively actuated by the first rocker arm or the second rocker arm, the valve bridge comprising:

a first end, a second end opposite to the first end, and a top surface of a bridge body portion connecting the first and second ends, wherein the top surface of the bridge body portion is configured to engage with the first rocker arm;

a recess disposed at a top of the first end, wherein the recess is configured to engage with a spherical end of the second rocker arm;

a first valve seat disposed at a bottom of the first end and having a curved bottom surface to engage the first valve, the first valve seat forming a channel extending longitudinally toward the second end; and a second valve seat disposed at a bottom of the second end to engage the second valve, wherein the valve bridge is configured to:

translate vertically upon actuation by the first rocker arm to actuate both the first and second valves, or tilt angularly upon actuation by the second rocker arm to actuate the first valve without actuating the second valve.

16. The rocker arm assembly of claim 15, wherein the first rocker arm is an exhaust rocker arm, and the second rocker arm is an engine brake rocker arm.

17. The rocker arm assembly of claim 15, wherein the recess has a shape that is at least partially ogive, and wherein the engagement between the recess and the spherical end of the second rocker arm forms a circular contact line.

18. The rocker arm assembly of claim 15, wherein the second end comprises a horizontal through hole and a kinematic cylinder rotatably inserted into the horizontal through hole.

19. The rocker arm assembly of claim 15, wherein the top surface comprises a guide for guiding movement of the valve bridge relative to the first rocker arm.

20. The rocker arm assembly of claim 1, wherein the first valve seat and the first recess are axially aligned.

* * * * *